United States Patent [19]

Shaffer

[11] 3,992,136

[45] Nov. 16, 1976

[54] PHOTOFLASH LAMP WITH POLYCARBONATE COATING

[75] Inventor: John W. Shaffer, Williamsport, Pa.

[73] Assignee: GTE Sylvania Incorporated, Montoursville, Pa.

[22] Filed: Nov. 1, 1974

[21] Appl. No.: 519,965

[52] U.S. Cl. ..... 431/94
[51] Int. Cl.[2] ..... F21K 5/02
[58] Field of Search ..... 431/94

[56] References Cited

UNITED STATES PATENTS

| | | | |
|---|---|---|---|
| 2,791,113 | 5/1957 | Anderson | 431/94 |
| 3,492,268 | 1/1970 | Baker | 260/47 X A |
| 3,635,895 | 1/1972 | Kramer | 260/47 X A |
| 3,770,366 | 11/1973 | Audesse et al. | 431/94 |
| 3,832,125 | 8/1974 | McDonough et al. | 431/94 |

*Primary Examiner*—Carroll B. Dority, Jr.
*Attorney, Agent, or Firm*—Edward J. Coleman

[57] ABSTRACT

A photoflash lamp having a polycarbonate coating over its glass envelope with an alkali-barrier coating disposed between the glass envelope and polycarbonate coating for extending the shelf-life of the polycarbonate coating by preventing alkali released by the glass from reacting with the polycarbonate. The alkali-barrier coating may be applied to the glass envelope before vacuum-forming a preformed polycarbonate sleeve thereon, or the alkali-barrier may be applied as a thin film on the interior surface of a preformed polycarbonate sleeve before vacuum-forming the sleeve onto the glass envelope.

15 Claims, 4 Drawing Figures

PHOTOFLASH LAMP WITH POLYCARBONATE COATING

BACKGROUND OF THE INVENTION

This invention relates to photoflash lamps and, more particularly, to an improved protective coating for flashlamps.

A typical photoflash lamp comprises an hermetically sealed glass envelope, a quantity of combustible material located in the envelope, such as shredded zirconium or hafnium foil, and a combustion supporting gas, such as oxygen, at a pressure well above one atmosphere. The lamp also includes an electrically or percussively activated primer for igniting the combustible to flash the lamp. During lamp flashing, the glass envelope is subject to severe thermal shock due to hot globules of metal oxide impinging on the walls of the lamp. As a result, cracks and crazes occur in the glass and, at higher internal pressures, containment becomes impossible. In order to reinforce the glass envelope and improve its containment capability, it has been common practice to apply a protective lacquer coating on the lamp envelope by means of a dip process. To build up the desired coating thickness, the glass envelope is generally dipped a number of times into a lacquer solution containing a solvent and a selected resin, typically cellulose acetate. After each dip, the lamp is dried to evaporate the solvent and leave the desired coating of cellulose acetate, or whatever other plastic resin is employed.

In the continuing effort to improve light output, higher performance flashlamps have been developed which contain higher combustible fill weights per unit of internal envelope volume, along with higher fill gas pressure. In addition, the combustible material may be one of the hotter burning types, such as hafnium. Such lamps, upon flashing, appear to subject the glass envelopes to more intense thermal shock effects, and thus require stronger containment vessels. One approach to this problem has been to employ a hard glass envelope, such as the borosilicate glass envelope described in U.S. Pat. No. 3,506,385, along with a protective dip coating of cellulose acetate. Although providing some degree of improvement in the containment capability of lamp envelopes, the use of cellulose acetate dip coatings and hard glass present significant disadvantages in the areas of manufacturing cost and safety. More specifically, the hard glass incurs considerably added expense over the more commonly used soft glass due to both increased material cost and the need for special lead-in wires to provide sealing compatibility with the hard glass envelope. In addition, even though more resistant to thermal shock, hard glass envelopes can also exhibit cracks and crazes upon lamp flashing, and, thus, do not obviate the need for a protective coating.

Another approach toward providing an improved containment vessel for photoflash lamps has been to employ a stronger, more temperature resistant coating material on the exterior of the glass envelope. For example, U.S. Pat. No. 3,156,107 describes a flashlamp having an exterior coating of polycarbonate resin, a material which exhibits relatively high impact and tensile strengths and a high softening temperature.

Yet a further approach to providing a more economical and improved containment vessel is described in a copending application Ser. No. 268,576, filed July 3, 1973 now Pat. No. 3,893,797 and assigned to the assignee of the present application. According to this previously filed application, a thermoplastic coating, such as polycarbonate, is vacuum formed onto the exterior surface of the glass envelope. The method of applying the coating comprises: placing the glass envelope within a preformed sleeve of the thermoplastic material; drawing a vacuum in the space between the thermoplastic sleeve and the glass envelope; and, simultaneosly heating the assembly incrementally along its length, whereby the temperature and vacuum cause the thermoplastic to be incrementally formed onto the glass envelope with the interface substantially free of voids, inclusions and the like. This method provides an optically clear protective coating by means of a significantly faster, safer and more economical manufacturing process, which may be easily integrated on automated production machinery.

Heat is employed in applying the polycarbonate resin coatings on the lamp envelopes. Subsequent cooling of the glass envelope and polycarbonate coating causes the buildup of high tensile forces in the coating because it tends to contract more than the glass. These forces can be reduced somewhat by heating a narrow band of the coating as described in U.S. Pat. No. 3,832,257. It has been found, however, that even such stress relieved coatings can crack and fail in a relatively short time under conditions of high humidity, even when the remaining stresses are within the accepted design limits for the polycarbonate resin used. It should be noted here that unstressed polycarbonate has good resistance toward humidity or even water immersion. In searching for a solution to this aging, or shelf-life, problem under humid conditions, an extensive literature survey failed to shed light on the cause of this unexpected cracking under stress levels allowed by good design practices.

Consideration was then given to the incorporation of a compatible plasticizer into the resin with the anticipation that it might promote relaxation and stretching and thereby relieve the stresses caused by differential contraction between the coating and glass. Evaluation of coatings containing, for example, 20 or 30 parts of a plasticizer to 100 parts of resin did in fact show significantly improved life under humid conditions. The plasticized polycarbonate was quite rigid rather than extensive as had been expected, and therefore, did not function in the manner anticipated. That is, the reduced coating stresses obtained with the plasticized resin where the result of a considerable lowering of the softening temperature needed for thermoforming. Cooling of the coated lamp over a lesser temperature gradient resulted in less stress build up. The shortcoming of the approach, however, was that the introduction of the required amounts of plasticizer resulted in substantial weakening of the coating, when compared to unplasticized polycarbonate. The resulting plasticized polycarbonate did not provide the desired stronger protective coating; more specifically, the plasticized polycarbonate coatings were not consistently better than cellulose acetate lacquer in containment tests with overcharged lamps. In addition, with respect to the preformed polycarbonate sleeves which are vacuum-formed onto the lamp, the low set point and poor strength at elevated temperatures of the plasticized polycarbonate made extraction of the injection molded sleeves from the mold a difficult, slow and uneconomical process.

SUMMARY OF THE INVENTION

In view of the foregoing, it is an object of this invention to provide a photoflash lamp having a strong protective coating with improved aging characteristics.

It is a particular object of this invention to greatly extend the shelf-life of thermoformed polycarbonate coatings on flashlamps, especially under conditions of high humidity and high mechanical stress.

A further object is to provide an improved containment vessel for a photoflash lamp by employing on the glass envelope of the lamp an exterior coating substantially comprising a polycarbonate resin which retains the toughness and high softening temperature for which polycarbonate is known, but which affords substantially improved resistance toward stress cracking under humid conditions.

Yet another object of the invention is to provide an improved method for coating the glass envelope of a photoflash lamp.

These and other objects, advantages, and features are attained in accordance with the invention by disposing an alkali-barrier coating between the glass envelope of the lamp and the exterior polycarbonate coating thereon. The barrier coating prevents alkali released by the glass from reacting with the polycarbonate coating and thereby extends the shelf-life of the polycarbonate coating, even under highly humid conditions.

In making lamps with vacuum-formed polycarbonate coatings, the alkali-barrier coating may be applied in a thin layer on the exterior surface of the glass envelope prior to placing the lamp within the preformed polycarbonate sleeve, or the barrier coating may be applied as a thin film on the interior surface of a preformed polycarbonate sleeve before placing an uncoated lamp within the sleeve.

BRIEF DESCRIPTION OF THE DRAWINGS

This invention will be more fully described hereinafter in conjunction with the accompanying drawings, in which.

DESCRIPTION OF PREFERRED EMBODIMENT

I have discovered that alkali originating from the glass envelope of the flashlamp can enter into the polycarbonate coating under humid conditions, and promote resin degradation evidenced by cracking and, in the most severe conditions, discoloration. I have also found that application of a thin alkali-barrier coating over the glass surface before application of the polycarbonate protects the polycarbonate coating to a dramatic degree under humid storage conditions. Even subjecting such lamps to steam (100°C and 100 percent relative humidity) for periods of 48 hours or greater produced no cracking, discoloration, or other evidence of polycarbonate degradation. Under identical conditions, similar control lamps, without an alkali barrier coating on the glass, show gross discoloration, cracking, and even flaking of the polycarbonate coating. Less severe conditions cause the same effect but require a considerably longer time to do so.

It is hypothesized that stress cracking of the polycarbonate under humid conditions is accompanied by localized scission of the polymer chains due to a hydrolytic mechanism. Small traces of alkali, either in the resin or its environment, appear to greatly accelerate this hydrolytic mechanism and probably act by way of basic catalysis. It has been shown that sufficient alkali is released from glass, as for example a lamp envelope, to measurably promote such failure of the polycarbonate in the presence of moisture.

A copending application, Ser. No. 519,966 filed concurrently herewith and now Pat. No. 3,947,224 in the name of the present inventor and assigned to the present assignee, approaches this problem of alkali-catalyzed hydrolysis of the polycarbonate resin by adding to the resin a small percentage of a compatible acidifying agent, such as phthalic anhydride. The acidified resin exhibits a substantially improved tolerance to chemical environments without at the same time diminishing the desired qualities of the polycarbonate. This improvement may be explained on the basis of the additive reacting with and thereby eliminating the traces of catalytic alkali that enter the resin.

The use of alkali-barrier coatings, as described herein, is compatible with and apparently additive to the protection afforded by acidifying of the polycarbonate resin, as described in the copending application. When the two techniques are used together, the alkali-barrier coating protects the polycarbonate from glass-originated alkali and the resin acidifier serves to provide protection from any environmental alkali (as, for example, alkaline vapors such as ammonia, amines, etc.)

The teachings of the present invention are applicable to either percussive or electrically ignited photoflash lamps of a wide variety of sizes and shapes. Accordingly, FIGS. 1 and 2 respectively illustrate electrically ignited and percussive-type photoflash lamps embodying the principles of the invention.

Figure 1:
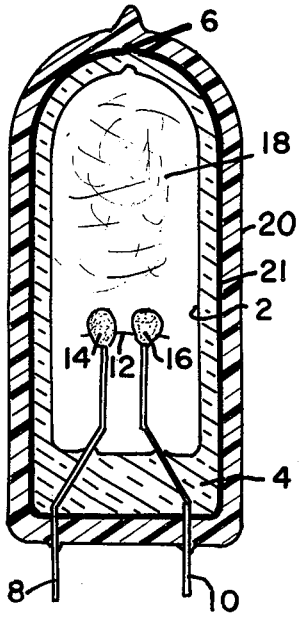
FIG. 1 is an enlarged sectional elevation of an electrically ignitable photoflash lamp having a polycarbonate coating with alkali-barrier in accordance with the invention.

Referring to FIG. 1, the electrically ignitable lamp comprises an hermetically sealed lamp envelope 2 of glass tubing having a press 4 defining one end thereof and an exhaust tip 6 defining the other end thereof. Supported by the press 4 is an ignition means comprising a pair of lead-in wires 8 and 10 extending through and sealed into the press. A filament 12 spans the inner ends of the lead-in wires, and beads of primer 14 and 16 are located on the inner ends of the lead-in wires 8 and 10 respectively at their junction with the filament. Typically, the lamp envelope 2 has an internal diameter of less than one-half inch, and an internal volume of less than 1 cc., although the present invention is equally suitable for application to larger lamp sizes. A combustion-supporting gas, such as oxygen, and a filamentary combustible material 18, such as shredded zirconium or hafnium foil, are disposed within the lamp envelope. Typically, the combustion-supporting gas fill is at a pressure exceeding one atmosphere, with the more recent subminiature lamp types having oxygen fill pressures of up to several atmospheres. As will be described in more detail hereinafter, the glass envelope 2 is reinforced by an exterior protective coating 20 substantially comprising a polycarbonate resin, with an alkali-barrier coating 21 disposed between the polycarbonate coating 20 and the glass envelope 2, in accordance with the invention.

Figure 2:
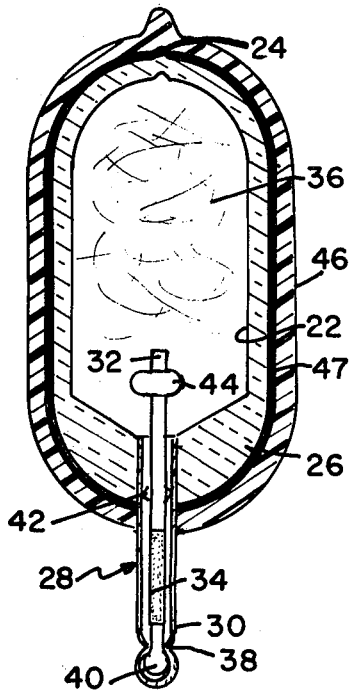
FIG. 2 is an enlarged sectional elevation of a percussive-type photoflash lamp having a polycarbonate coating with alkali-barrier in accordance with the invention.

The percussive-photoflash lamp illustrated in FIG.2 comprises a length of glass tubing defining an hermetically sealed lamp envelope 22 constricted at one end to define an exhaust tip 24 and shaped to define a seal 26 about a primer 28 at the other end thereof. The primer 28 comprises a metal tube 30, a wire anvil 32, and a charge of fulminating material 34. A combustible 36, such as filamentary zirconium or hafnium, and a combustion supporting gas, such as oxygen, are disposed within the lamp envelope, with the fill gas being at a pressure of greater than one atmosphere. As will be detailed hereinafter, the exterior surface of glass envelope 22 is covered by a polycarbonate coating 46, with an alkali-barrier coating 47 disposed between the polycarbonate coating 46 and glass envelope 22, inn accordance with the invention.

The wire anvil 32 is centered within the tube 30 and is held in place by a circumferential indenture 38 of the tube 30 which loops over the head 40, or other suitable protuberance, at the lower extremity of the wire anvil. Additional means, such as lobes 42 on wire anvil 32 for example, may also be used in stabilizing the wire anvil, supporting it substantially coaxial within the primer tube 30 and insuring clearance between the fulminating material 34 and the inside wall of tube 30. A metal or glass bead 44 is fused to the wire anvil 32 just above the inner mouth of the primer tube 30 to eliminate burn-through and function as a deflector to deflect and control the ejection of hot particles of fulminating material from the primer. The lamp of FIG. 2 is also typically a subminiature type having envelope dimensions similar to those described with respect to FIG. 1.

Although the lamp of FIG. 1 is electrically ignited, usually from a battery source, and the lamp of FIG. 2 is percussion-ignitable, the lamps are similar in that in each the ignition means is attached to one end of the lamp envelope and disposed in operative relationship with respect to the filamentary combustible material. More specifically the igniter filament 12 of the flash lamp in FIG. 1 is incandesced electrically by current passing through the metal filament support leads 8 and 10, whereupon the incandesced filament 12 ignites the beads of primer 14 and 16 which in turn ignite the combustible 18 disposed within the lamp envelope. Operation of the percussive-type lamp of FIG. 2 is initiated by an impact onto tube 30 to cause deflagration of the fulminating material 34 up through the tube 30 to ignite the combustible 36 disposed within the lamp envelope. The invention is also applicable to other types of electrically ignited lamps, such as those having spark gap or primer bridge ignition structures.

The requirements of an alkali-barrier coating (21 or 47) are that it be transparent, substantially impermeable to water vapor and to actual alkaline ions, such as sodium from the glass envelope of the lamp, and that it remain intact during the thermal and mechanical abuse to which it is subjected during application of the polycarbonate primary lamp coating. A preferred coating of this type is a thin (0.001 inch or less is sufficient) film of polytetra-fluoroethylene (Teflon). This may be formed by dipping the flashlamp into an aqueous or solvent type dispersion of polytetrafluoroethylene, drying, and then sintering of the white particulate coating by briefly heating it with a stream of, e.g., 350° C, air. The resultant continuous film is transparent and impermeable to water vapor and alkali from the glass.

By way of example, the following are among the coating materials that would appear suitable for use as the alkali-barrier coating (21 or 47) in accordance with the invention: polytetrafluoroethylene, epoxy resins, polychlorotrifluoroethylene fluids or resins, fluorinated hydrocarbon fluids or resins, polypropylene, polymethyl-methacrylate, thermosetting acrylic resins, polyvinylidine chloride, silicone resins and fluids, allyl resins, polyallomers, polybutylene polyesters, polymethylpentene, polysulfone, chlorinated polyvinyl chloride, and the natural waxes, such as carnauba wax.

The outer coating 20 or 46 typically has a thickness greater than about 0.015 inch and may comprise either an unmodified polycarbonate resin or a resin which has been acidified as described in the copending application Ser. No. 519,966 now Pat. No. 3,947,224. As set forth therein, the acidified resin comprises a homogeneous mixture of from about 70 to 99.9 percent by weight of a polycarbonate resin and from about 0.1 to 30 percent by weight of a compatible acidifying agent. For flashlamp coating applications, an acidifying agent concentration from about 0.5 to 1.5 percent by weight is deemed optimal. That is, the acidified resin of a flashlamp coating comprises a homogeneous mixture of from about 98.5 to 99.5 percent by weight of polycarbonate resin and from about 0.5 to 1.5 percent by weight of an acidifying agent which is soluble in the resin, such as phthalic anhydride. Further the acid or anhydride of an acid employed as the additive should have a first ionization pKa value in a range of from about 1.0 to 6.5, with acidifying agents having a pKa value between 1.5 and 4.5 being preferred. The acidifying agent should also have a sufficiently high boiling point (or low vapor pressure at polycarbonate processing temperatures), to not cause bubbles or voids in the coating on the finished flashlamp.

By way of example, the following are among the acidifying agents that would appear suitable for use as an additive modify the polycarbonate resin for improved aging.

| Additive | (First Ionization) pKa | Boiling Point ° C |
|---|---|---|
| benzoic acid | 4.19 | 249 |
| phthalic anhydride | (acid 2.89) | 284 |
| phenylacetic acid | 4.28 | 266 |

An alternative to the addition of acidic materials to polycarbonate resins is to incorporate a source of acid internal to the molecular structure itself. By way of illustrative example only, acidic moieties such as carboxyl groups could be affixed regularly or at random along the length of the polycarbonate chain. Such internally acidified polycarbonate resins should offer properties and advantages similar to those obtained through blending of an acidic substance into an unmodified resin.

One method of applying the alkali-barrier and polycarbonate coatings to the flashlamps of FIGS. 1 and 2 would be to employ a lacquer dip process. That is, the glass envelope of the lamp is first dipped in an aqueous or solvent type dispersion or solution of the alkali-barrier material and then dried, as described hereinbefore.

Then, the film-coated lamp is dipped into a polycarbonate resin lacquer, as described in U.S. Pat. No. 3,156,107. Another method of application is to employ a fluidized bed process, such as that described in a copending application Ser. No. 482,038 filed June 24, 1974, now U.S. Pat. No. 3,959,525, and assigned to the present assignee; in this instance, the alkali-barrier coating could be provided by a first fluidizing process involving a fluidized bed of powdered alkali-barrier material, after which the outer lamp coating could be provided by a second fluidizing process involving a fluidized bed of powdered polycarbonate resin. However, the previously referred to vacuum-forming method of application is preferred and shall now be briefly described.

Figure 3:
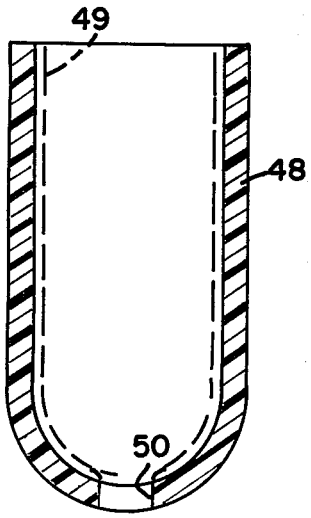
FIG. 3 is an enlarged sectional elevation of a preformed polycarbonate sleeve adapted for assembly and vacuum forming onto the glass envelope of a percussive-type photoflash lamp; and, FIG. 4 is an enlarged elevation, partly in section, showing a percussive flashlamp assembled in the polycarbonate sleeve of FIG. 3, prior to vacuum forming.

Referring to FIG. 3, the polycarbonate resin to be coated on the exterior surface of the lamp envelope is initially provided as a preformed sleeve 48 having the shape of a test tube. To facilitate the one or more metallic members depending from the lamp envelope (i.e. leads 8 and 10, or primer tube 30) one or more holes are provided at the bottom of test tube-shaped sleeve. For purposes of example, the method will be described with reference to vacuum forming the coating 46 on the percussive lamp of FIG. 2, although it will be understood that a similar method may be employed with the electrically ignited lamp of FIG. 1. Accordingly, sleeve 48 is provided with a single coaxially disposed hole 50 to facilitate passage of coaxially projecting primer tube 30. Sleeve 48 may be formed by a molding or extrusion process, and to minimize possible checks and crazes in the plastic upon being vacuum formed to the glass envelope, the preformed sleeve 48 should be prebaked at about 125°C for at least 15 minutes to drive away residual moisture prior to assembly with the glass envelope.

In accordance with the present invention, before assembling the sleeve on the envelope, a thin film coating (represented by the dashed line 5 in FIG. 4) of a clear alkali-barrier material is applied on the exterior of the glass envelope 22. A continuous coating thickness of 0.001 inch or less is sufficient. Preferably, the alkali-barrier material is a resin-type, such as polytetrafluoroethylene, which is formed onto the envelope by dipping the lamp into an aqueous or solvent type dispersion of the material, drying, and then sintering the coating by briefly heating it with a stream of air. Alternatively, the alkali-barrier material may be sprayed onto the exterior of the glass envelope and then dried.

Figure 4:
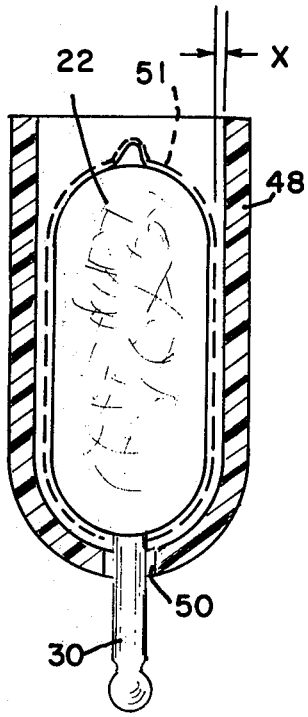

In the next step, shown in FIG. 4, the film coated glass envelope 22 of the percussive lamp is placed within the preformed sleeve 48, with the primer tube 30 projecting through hole 50. It will be noted that both the sleeve 48 and the lamp envelope 22 have generally tubular sidewalls. To facilitate the vacuum forming process, the fit should be as close as possible. Accordingly, the outside diameter of the tubular envelope 22 and the inside diameter of the tubular sleeve 48 are dimensioned so that, when the envelope is placed within the sleeve, there exists a clearance $x$ of from about 0.001 to 0.010 inch between the tubular sidewalls thereof prior to heating the vacuum forming.

The next step, forming the sleeve onto the coated envelope, comprises drawing a vacuum in the space between the sleeve 48, and envelope 22, while simultanously heating the envelope and sleeve assembly incrementally along its length. More specifically, the vacuum is drawn through a tube at the open end of sleeve 48, while at the same time, heaters are controlled to heat the sleeve to approximately the softening temperature of the polycarbonate. A relative incremental axial movement is effected between the envelope-sleeve assembly and the heaters, so that incremental heating in a localized elevational plane starts at the end of the sleeve 48 through which the primer tube 30 projects, and then proceeds towards the open end of the sleeve from which the vacuum is being drawn. In this manner, the temperature and vacuum cause the sleeve 48 to be formed onto the glass envelope 22 with the interface therebetween substantially free of voids, inclusions and the like. Of course, each heater may cover a broad area of the sleeve, and the vacuum may not be drawn until at or near the end of the heating process.

At the conclusion of the incremental heating process, the heated sleeve 48 is constricted above the exhaust tip 24 while continuing to draw a vacuum. Finally, the vacuum-formed coating 48 on the lamp is separated from the unused portion of the sleeve and tipped off, thereby completing the encapsulation of the film-coated glass envelope in the polycarbonate resin coating 46. Commercial blue dyes can be used in the sleeve, or coating, for color corrections desirable with various photographic color film.

An alternative approach is to apply a thin film coating of the alkali-barrier material on the interior surface of the preformed sleeve 48, rather than coating the exterior surface of the glass envelope 22. This alternative coating is represented by the dashed line 49 in FIG. 3. Such a step would occur after the step of prebaking the sleeve, but before assembling the glass envelope within the sleeve. To achieve a suitably continuous thin film coating 49, without blocking the hole 50 at the bottom of the sleeve, a fluid-type alkali-barrier, rather than a resin, is preferred when coating the sleeve. One specific approach is to place the sleeve 48 in a basket and then immerse the basket in a solvent solution of the fluid. In this instance, the preferred alkali-barrier material is a silicone fluid (e.g., an alkylmethyl polysiloxane in which the alkyl group is a saturated moiety containing an average of from 4 to 16 carbon atoms) or polychlorotrifluoroethylene fluid, and it is dissolved in trichlorotrifluoroethane or a low boiling hydrocarbon, such as petroleum ether, to provide the dip solution. After dipping, the basket is withdrawn from the solution, and the coated sleeve is tumbled in a rotating wire cage to remove droplets of fluid, after which the sleeve is dried in a low temperature air flow or warm oven. Alternatively, the alkali-barrier fluid may be sprayed on the interior of the sleeve. The remainder of the encapsulation process is as described above.

As the polycarbonate resin has a coefficient of thermal expansion several times greater than the coefficient of thermal expansion of the glass envelope, the coating 46, provided by the above described vacuum-forming process, will exert a compressive load on the glass envelope 22 to thereby in effect strengthen the glass and make it more resistant to thermal shock. For example, with a coefficient of thermal expansion at least six times greater than that for the glass, the polycarbonate coating may exert a compressive load of from about 1000 to about 3000 pounds per square inch on the glass envelope depending upon the relative thicknesses of the glass envelope and polycarbonate coating. Preferred tensile loading in the polycarbonate coating would be from 1000 to no more than 2000 psi.

In one typical embodiment of the invention, an electrical flashlamp of the type shown in FIG. 1 was provided with a thin film alkali-barrier coating 21 of a silicone fluid and a clear vacuum-formed coating 20 of acidified polycarbonate resin having a wall thickness of about 0.027 inch. More specifically, the outer coating material 20 comprises a homogeneous mixture of about 99 percent by weight of an injection molding grade of bisphenol A polycarbonate resin (specifically Merlon type M-50 resin of the Mobay Chemical Co., Pittsburgh, Pa.) and about 1 percent by weight of phthalic anhydride. The lamp contained a combustible fill 18 comprising 25 mgs. of shredded hafnium foil and oxygen at a fill pressure of about 12.8 atmospheres. The tubular envelope 2 was formed of G-1 type soft glass and had a nominal outside diameter of 0.259 inch, a wall thickness of 0.030 inch, an overall outside length of 0.980 inch, and an internal volume of 0.32 cc. In the process of coating the lamp, an injection molded sleeve of clear acidified polycarbonate resin having a nominal inside diameter of about 0.283 inch at the open end, which narrows to about 0.264 inch, and a wall thickness of 0.025 inch was employed. The sleeve had two holes at the bottom for accommodating leads 8 and 10. Prior to assembly, the interior of the sleeve was sprayed with Dow Corning silicone fluid No. 230 (an alkylmethyl polysiloxane in which the alkyl group is a saturated moiety containing an average of about ten carbon atoms); after drying, this provided the alkali-barrier coating. During vacuum forming, the molded sleeve was incrementally heated to a temperature of about 400°F by air from a serpentine heater. Flashing of a number of these lamps in both the vertical and horizontal position exhibited no containment failures.

In summary, the present invention provides an alkali-barrier coating between the glass vessel of the flashlamp and a polycarbonate primary coating so as to protect the polycarbonate resin from base-catalyzed chain scission and deterioration upon storage and aging. A particular advantage of the invention is provision of an undercoating which imparts long-term shelf stability to an otherwise superior polycarbonate reinforcing coating for flashlamps. Another advantage is that the alkali-barrier appears to eliminate the need for extra stress-relieving operations such as heat "striping" of the polycarbonate coating after application and cooling. It should be pointed out that the shelf-life gains realized by application of the inventive principles described herein far exceed those attainable by stress-controlling of the polycarbonate, whatever the method used.

Although the invention has been described with respect to specific embodiments, it will be appreciated that modifications and changes may be made by those skilled in the art without departing from the true spirit and scope of the invention.

What I claim is:

1. A photoflash lamp comprising an hermetically sealed glass envelope, a combustion-supporting gas in said envelope, a quantity of combustible material located in said envelope, ignition means attached to said envelope and disposed in operative relationship to said combustible material, a protective coating substantially comprising an acidified polycarbonate resin on the exterior surface of said glass envelope, and an alkali-barrier coating disposed between said polycarbonate coating and said glass envelope for extending the shelf-life of said polycarbonate coating under humid conditions by preventing alkali released by said glass envelope from reacting with said polycarbonate coating.

2. A lamp according to claim 1 wherein the composition of said alkali-barrier coating comprises a material selected from the group consisting of polytetrafluoroethylene, epoxy resins, polychlorotrifluoroethylene fluids or resins, fluorinated hydrocarbon fluids or resins, polypropylene, polymethyl-methacrylate, thermosetting acrylic resins, polyvinylidine chloride, silicone resins and fluids, allyl resins, polyallomers, polybutylene, polyesters, polymethylpentene, polysulfone, chlorinated polyvinyl chloride, and the natural waxes such as carnauba wax.

3. A lamp according to claim 2 wherein said alkali-barrier coating is clear.

4. A lamp according to claim 1 wherein said alkali-barrier coating is disposed as a thin film between said glass envelope and said acidified polycarbonate coating.

5. A lamp according to claim 1 wherein the thickness of said alkali-barrier coating is less than about 0.001 inch.

6. A lamp according to claim 1 wherein the thickness of said acidified polycarbonate coating is greater than about 0.015 inch.

7. A lamp according to claim 1 wherein the acidified resin of said polycarbonate coating comprises a homogeneous mixture of from about 70 to 99.9 percent by weight of a polycarbonate resin and from about 0.1 to 30 percent by weight of a compatible acidifying agent having a first pKa value in a range from about 1.0 to 6.5.

8. A lamp according to claim 1 wherein said acidified polycarbonate coating is vacuum-formed on said envelope and exerts a compressive load on the glass envelope of from about 1000 to 3000 pounds per square inch.

9. A lamp according to claim 1 wherein said polycarbonate coating comprises a preformed sleeve of material substantially comprising an acidified polycarbonate resin which has been vacuum-formed onto said glass envelope.

10. A lamp according to claim 9 wherein said alkali-barrier coating comprises a resin.

11. A lamp according to claim 10 wherein said alkali-barrier coating comprises polytetrafluoroethylene.

12. A lamp according to claim 9 wherein said alkali-barrier coating comprises a thin film.

13. A lamp according to claim 12 wherein said alkali-barrier coating is a polychlorotrifluoroethylene fluid or an alkylmethyl polysiloxane in which the alkyl group is a saturated moiety containing an average of from 4 to 16 carbon atoms.

14. A photoflash lamp comprising an heremetically sealed glass envelope, a combustion-supporting gas in said envelope, a quantity of combustible material located in said envelope, ignition means attached to said envelope and disposed in operative relationship to said combustible material, a protective coating substantially comprising a polycarbonate resin on the exterior surface of said glass envelope, and an alkali-barrier coating disposed between said polycarbonate coating and said glass envelope for extending the shelf-life of said polycarbonate coating under humid conditions by preventing alkali released by said glass envelope from reacting with said polycarbonate coating, said alkali-barrier coating comprising a polychlorotrifluoroethylene fluid or an alkylmethyl polysiloxane in which the alkyl group is a saturated moiety containing an average of from 4 to 16 carbon atoms.

15. A photoflash lamp comprising an hermetically sealed glass envelope, a combustion-supporting gas in said envelope, a quantity of combustible material located in said envelope, ignition means attached to said envelope and disposed in operative relationship to said combustible material, a protective coating substantially comprising a polycarbonate resin on the exterior surface of said glass envelope, and an alkali-barrier coating disposed between said polycarbonate coating and said glass envelope for extending the shelf-life of said polycarbonate coating under humid conditions by preventing alkali released by said glass envelope from reacting with said polycarbonate coating, the composition of said alkali-barrier coating comprising a material selected from the group consisting of polypropylene, polyvinylidine chloride, polybutylene, polymethylpentene, and chlorinated polyvinyl chloride.

* * * * *